US009611992B2

(12) United States Patent
Scales

(10) Patent No.: US 9,611,992 B2
(45) Date of Patent: Apr. 4, 2017

(54) LAMP RETROFITTING ASSEMBLY

(71) Applicant: Garden Peninsulas, LLC, Troy, MI (US)

(72) Inventor: Robert L. Scales, Troy, MI (US)

(73) Assignee: Garden Peninsulas, LLC, Troy, MI (US)

( * ) Notice: Subject to any disclaimer, the term of this patent is extended or adjusted under 35 U.S.C. 154(b) by 0 days.

(21) Appl. No.: 14/750,052

(22) Filed: Jun. 25, 2015

(65) Prior Publication Data

US 2015/0377432 A1 Dec. 31, 2015

Related U.S. Application Data

(60) Provisional application No. 62/018,080, filed on Jun. 27, 2014.

(51) Int. Cl.

| | |
|---|---|
| ***F21V 17/06*** | (2006.01) |
| ***F21S 8/04*** | (2006.01) |
| ***F21V 21/002*** | (2006.01) |
| ***H01R 33/94*** | (2006.01) |
| *F21V 23/06* | (2006.01) |

(Continued)

(52) U.S. Cl.

CPC ..... *F21S 8/043* (2013.01); *F21V 21/002* (2013.01); *H01R 33/94* (2013.01); *F21S 8/063* (2013.01); *F21V 3/02* (2013.01); *F21V 17/12* (2013.01); *F21V 17/14* (2013.01); *F21V 23/06* (2013.01); *H01R 33/22* (2013.01)

(58) Field of Classification Search

CPC ..... F21V 17/06; F21V 17/08; F21V 17/10; F21V 17/12; F21V 19/0035; F21V 19/0055; F21V 19/0065; F21V 19/0085; F21S 8/043; H01R 33/22; H01R 33/94

See application file for complete search history.

(56) References Cited

U.S. PATENT DOCUMENTS 1,086,426 A * 2/1914 Wakefield ..... F21V 17/00 362/437

2,420,208 A * 5/1947 Solomon ..... F21V 1/02 362/433

(Continued)

OTHER PUBLICATIONS

Written Opinion of the International Searching Authority, Dec. 8, 2015.

*Primary Examiner* — Julie Bannan

(74) *Attorney, Agent, or Firm* — Simonelli IP, PLLC

(57) ABSTRACT

A lamp retrofitting assembly decorates a ceiling lamp having a bulb socket and a socket thread design to receive a threaded electrical contact surface of a light bulb therein. The lamp retrofitting assembly includes a socket extender having a male threaded electrical contact surface to threadingly engage the socket thread and a female threaded electrical contact surface that receives the threaded electrical contact surface of the light bulb. The lamp deflector is removably securable to the socket extender. The lamp deflector includes an inner circumference defining an extender hole and an outer circumference. The lamp deflector also includes an uninterrupted deflecting surface extending between the inner and outer circumferences. The lamp deflector receives the socket extender within the extender hole. A retainer is securable to the socket extender. The retainer retains the decorative lamp deflector to the socket extender.

10 Claims, 16 Drawing Sheets

(51) Int. Cl.

| | |
|---|---|
| *H01R 33/22* | (2006.01) |
| *F21S 8/06* | (2006.01) |
| *F21V 3/02* | (2006.01) |
| *F21V 17/12* | (2006.01) |
| *F21V 17/14* | (2006.01) |

(56) References Cited

U.S. PATENT DOCUMENTS

| | | | | |
|---|---|---|---|---|
| 2,781,444 | A | 2/1955 | Noguchi | |
| 4,124,880 | A * | 11/1978 | Dart | B60Q 1/2611 362/35 |
| 4,504,888 | A * | 3/1985 | Rosenthal | G03B 15/02 362/17 |
| 5,134,554 | A * | 7/1992 | Donato | F21S 8/06 362/254 |
| 5,398,178 | A * | 3/1995 | Roth | F21V 17/12 362/296.01 |
| 5,573,326 | A | 11/1996 | Iijima | |
| 5,791,768 | A * | 8/1998 | Splane, Jr. | F21V 7/0025 362/280 |
| 6,039,463 | A * | 3/2000 | Lin | F21S 6/002 362/410 |
| 6,273,590 | B1 * | 8/2001 | Splane, Jr. | F21S 8/04 362/281 |
| 6,758,578 | B1 * | 7/2004 | Chou | F21V 17/06 362/391 |
| 7,311,425 | B2 | 12/2007 | Jervey, III | |
| 8,118,449 | B2 | 2/2012 | Pawelko et al. | |
| 8,721,107 | B2 * | 5/2014 | Cotzias | F21V 1/00 362/147 |
| 2002/0015307 | A1 | 2/2002 | Splane, Jr. | |
| 2004/0190301 | A1 * | 9/2004 | Blateri | F21V 17/168 362/453 |
| 2009/0201682 | A1 | 8/2009 | Dyson | |
| 2010/0002451 | A1 | 1/2010 | Reynolds | |
| 2010/0068899 | A1 | 3/2010 | Shvili | |
| 2012/0257395 | A1 | 10/2012 | Cotzias | |
| 2013/0188362 | A1 | 7/2013 | Howe | |

* cited by examiner

LAMP RETROFITTING ASSEMBLY

BACKGROUND ART

1. Field of the Invention

The invention relates to light fixtures. More particularly, the invention relates to assemblies to modify a standard ceiling or wall mounted light fixture.

2. Description of the Related Art

U.S. Pat. No. 8,721,107 discloses a method and apparatus for retrofitting an open bulb lighting fixture to enclose the bulb within a light cover. The light cover requires a light cover flange to which the light cover is secured. The light cover flange includes a plurality of holes extending therethrough to ventilate the light cover assembly from the heat generated by the light bulb stored therewithin.

SUMMARY OF THE INVENTION

A lamp retrofitting assembly decorates a ceiling lamp having a bulb socket and a socket thread design to receive a threaded electrical contact surface of a light bulb therein. The lamp retrofitting assembly includes a socket extender having a male threaded electrical contact surface to threadingly engage the socket thread. The socket extender includes a female threaded electrical contact surface spaced apart from and in electrical contact with said male threaded electrical contact surface. The female threaded electrical contact surface receives the threaded electrical contact surface of the light bulb. The lamp deflector is removably securable to the socket extender. The lamp deflector includes an inner circumference defining an extender hole and an outer circumference. The lamp deflector also includes an uninterrupted deflecting surface extending between the inner and outer circumferences. The lamp deflector receives the socket extender within the extender hole. A retainer is securable to the socket extender. The retainer retains the decorative lamp deflector to the socket extender.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENTS

Figure 1:
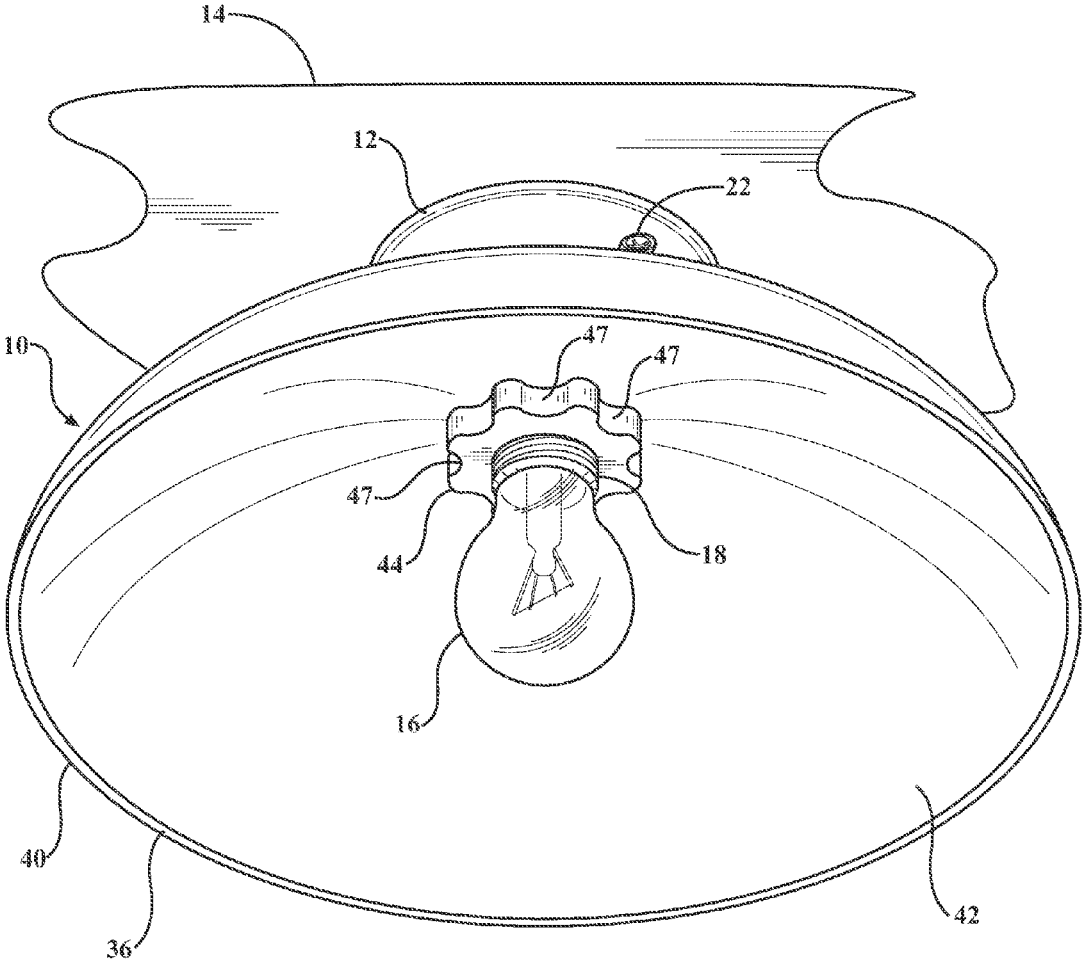
FIG. 1 is a perspective view of one embodiment of the invention secured to a ceiling lamp with a light bulb fixedly secured thereto.
Figure 2:
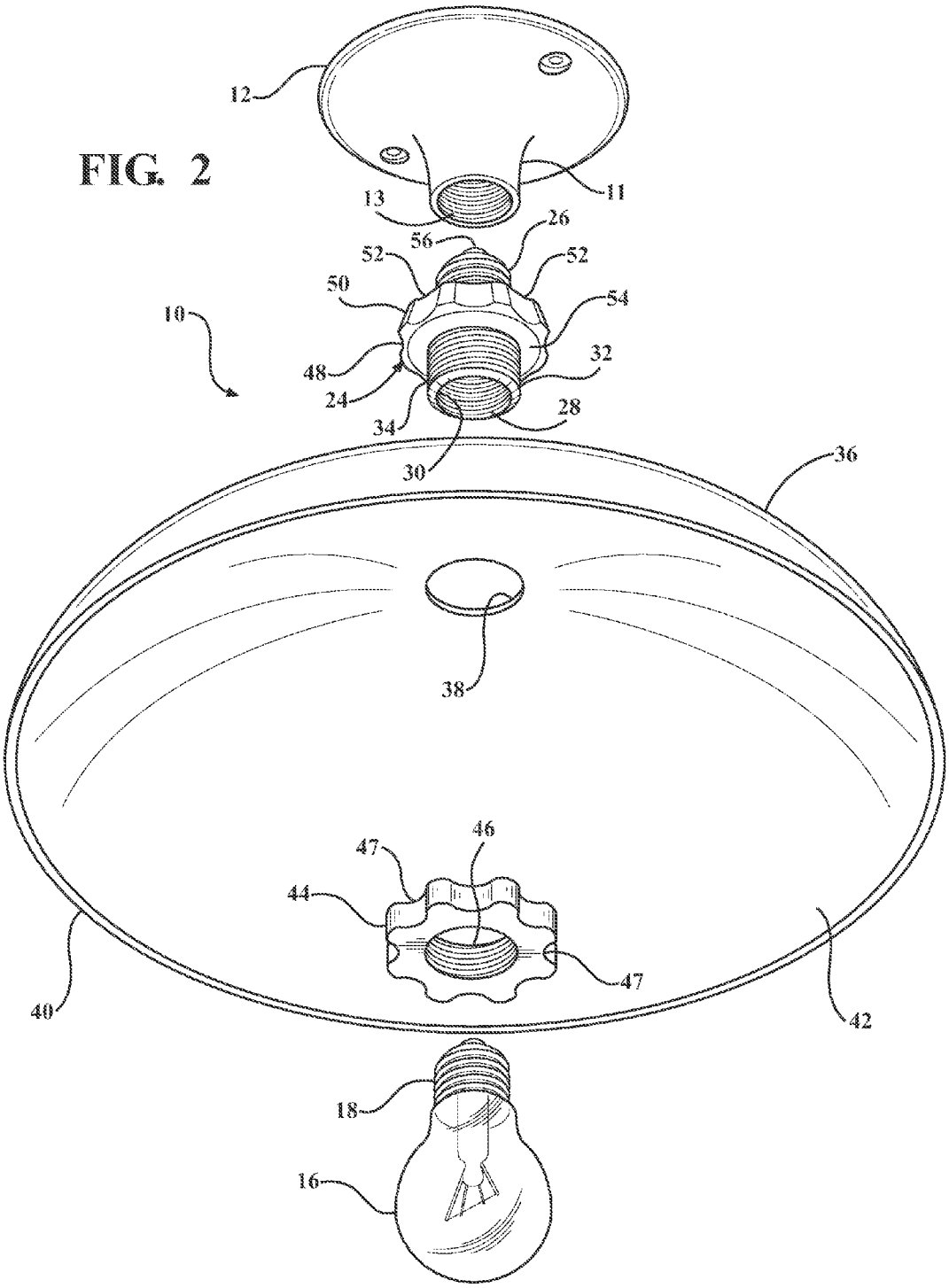
FIG. 2 is an exploded perspective view of the embodiment shown in FIG. 1.
Figure 3:
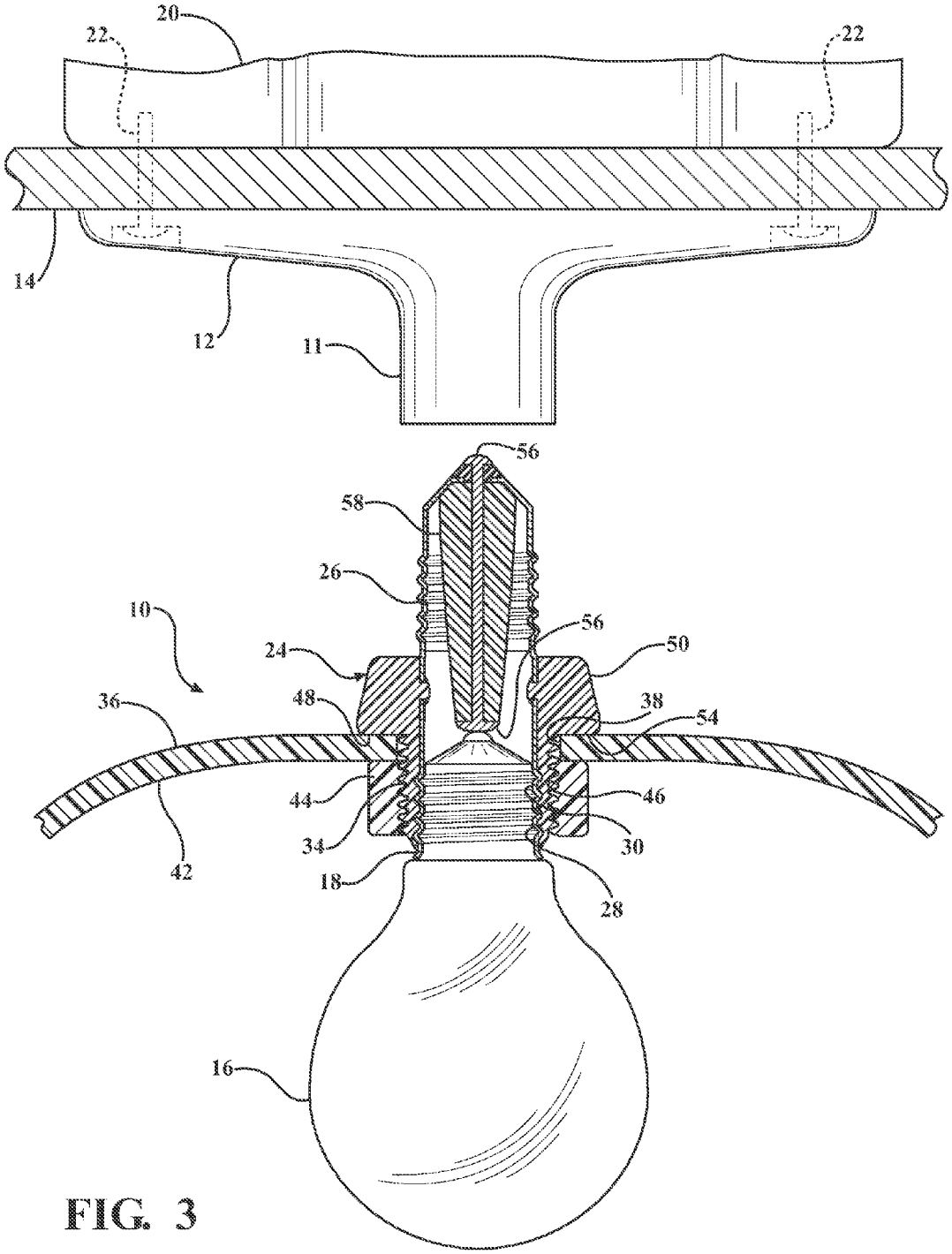
FIG. 3 is a cross-section side view of the embodiment shown in FIG. 1.
Figure 4:
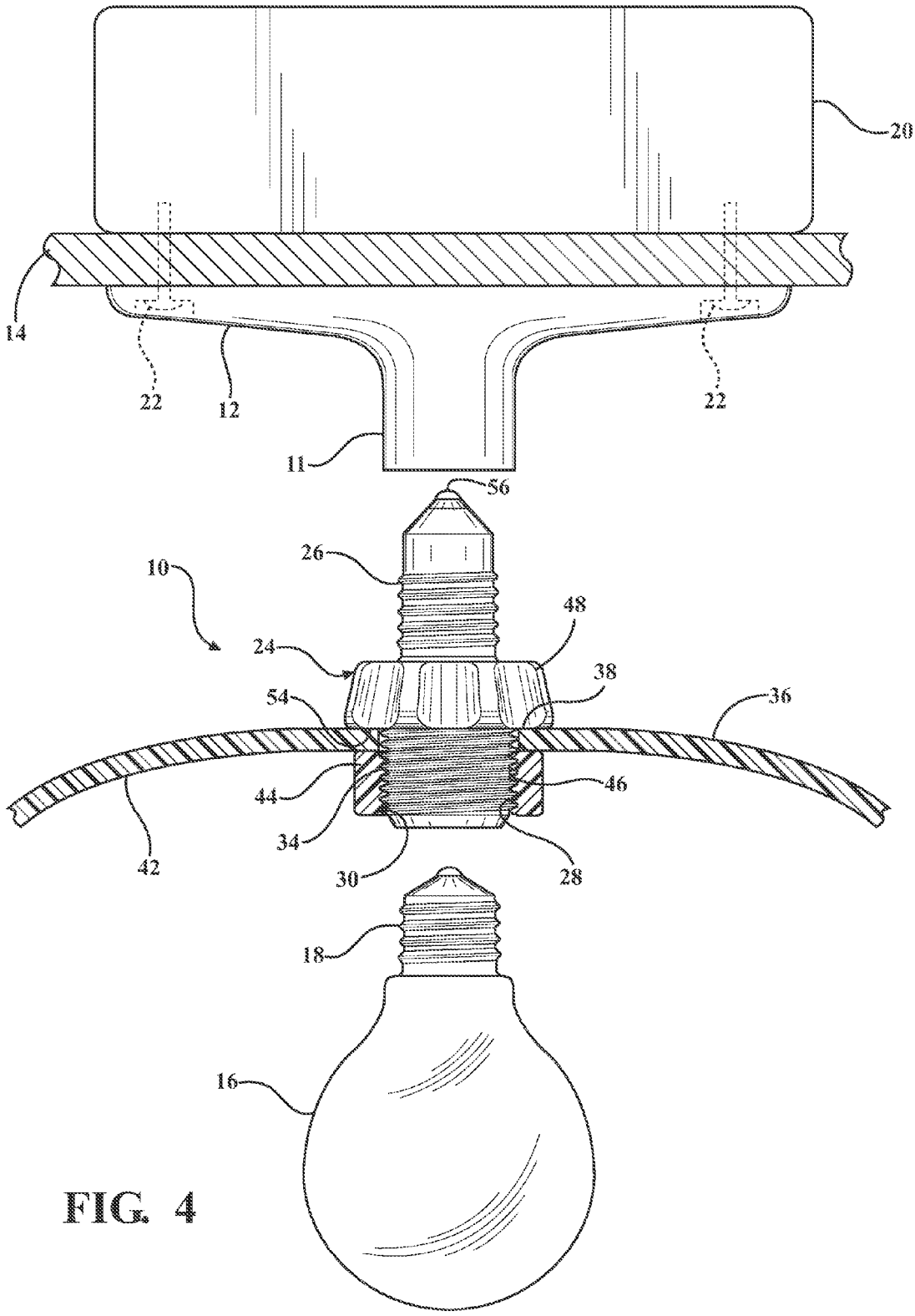
FIG. 4 is a partial cross-section of the embodiment shown in FIG. 1.

In all of the Figures, a lamp retrofitting assembly is generally indicated at 10, wherein similar elements in alternative embodiments have similar reference numerals but are offset by 100, 200, 300, etc. The lamp retrofitting assembly 10 is used in conjunction with a ceiling lamp 12 that is fixedly secured to a ceiling 14. The ceiling lamp 12 defines a socket having socket 11 with a socket thread 13 therein. A light bulb 16 is secured to the lamp retrofitting assembly 10 where it is electrically connected to the ceiling lamp 12 so that it may selectively emit light when the circuit through the ceiling lamp 12 is turned on. In other words, the lamp retrofitting assembly 10 is positioned between the ceiling lamp 12 and the light bulb 16. It should be appreciated by those skilled in the art that the light bulb 16 is shown as an incandescent light bulb, but that any technology used in the light bulb may be utilized by the lamp retrofitting assembly 10. The light bulb 16 includes a socket thread 18. A lamp box 20 is mounted within the ceiling 14 to which the ceiling lamp 12 is fixedly secured using screws 22.

Referring now specifically to FIGS. 1 through 4, the lamp retrofitting assembly 10 is used to decorate the ceiling lamp 12. The lamp retrofitting assembly 10 may also deflect light emitted from the light bulb 16 that may be directed upwardly toward the ceiling 14. The lamp retrofitting assembly includes a socket extender, generally shown at 24. The socket extender 24 includes a male threaded electrical contact 26 which threadingly engages the socket thread 13 of the ceiling lamp 12. The socket extender 24 also includes a female threaded electrical contact surface 28. The female threaded electrical contact surface 28 is spaced apart from and in electrical contact with the male threaded electrical contact surface 26. In the embodiment shown, the female 28 and male 26 threaded electrical contact surfaces are coaxial. The female threaded electrical contact surface 28 receives the threaded electrical contact surface 18 of the light bulb 16 therein. The female threaded electrical contact surface 28 also defines an inner circumference 30 of the socket extender 24. Disposed on an outer circumference 32 is a distal male threaded surface 34 which will be discussed in greater detail subsequently.

A lamp deflector 36 includes an inner deflector circumference 38 and an outer deflector circumference 40. The inner deflector circumference 38 defines an extender hole to receive the socket extender 24 therethrough. The lamp deflector 36 defines a deflector surface 42 that extends uninterrupted between the inner 38 and outer 40 deflector circumferences. The inner deflector circumference 38 receives the distal male threaded surface 34 of the socket extender 24 therethrough.

A retainer 44 is securable to the socket extender 24. The retainer 44 includes an inner threaded retainer surface 46 that threadingly engages the distal male threaded surface 34 of the socket extender 24. Alternatively, a turn lock engagement system can be used in place of the inner threaded retainer surface 46 combined with the distal male threaded surface 34 (as is discussed below and shown in FIG. 15). The retainer 44 retains the lamp deflector 36 to the socket extender 24. The retainer 44 defines a plurality of finger detents 47. These finger detents 47 may be replaced by shallower detents or a knurled surface.

The socket extender 24 also includes a deflector stop 48. The deflector stop 48 includes an outer surface 50 having a plurality of detents 52 used for grasping the deflector stop 48. It should be appreciated by those skilled in the art that the plurality of detents 52 may be replaced by with shallower detents or a knurled surface or some other surface used to facilitate grasping. The deflector stop 48 extends between the male threaded electrical contact surface 26 and the female threaded electrical contact surface 28. Alternatively, the deflector stop 48 extends between the male threaded electrical contact surface 26 and the distal male threaded surface 34 of the socket extender 24. The deflector stop 48 is made of an insulating material preventing the user thereof from receiving an electrical shock when mounting the lamp retrofitting assembly 10 to the socket 11 or removing it therefrom. The distal male threaded surface 34 is also made of an insulating material for the same purpose.

The deflector stop 48 includes a relief 54. The relief 54 defines a plane perpendicular to the axis of the socket extender 24. The relief 54 extends radially out from the socket extender 24 between the male threaded electrical contact surface 26 and the female threaded electrical contact surface 28. The relief 54 receives the lamp deflector 36 thereagainst preventing the lamp deflector 36 from moving past the deflector stop 48. When the lamp deflector 36 is installed, the lamp deflector 36 is positioned between the relief 54 of the deflector 48 and the retainer 44.

The socket extender 24 includes an electrical extension 56 extending up through the socket extender 24 allowing electrical contact between the circuit (not shown) within the socket 11 of the ceiling lamp 12 and a light bulb bead 57 of the light bulb 16. In the embodiment shown, the electrical extension 56 is encapsulated in an insulator 58.

Figure 5:
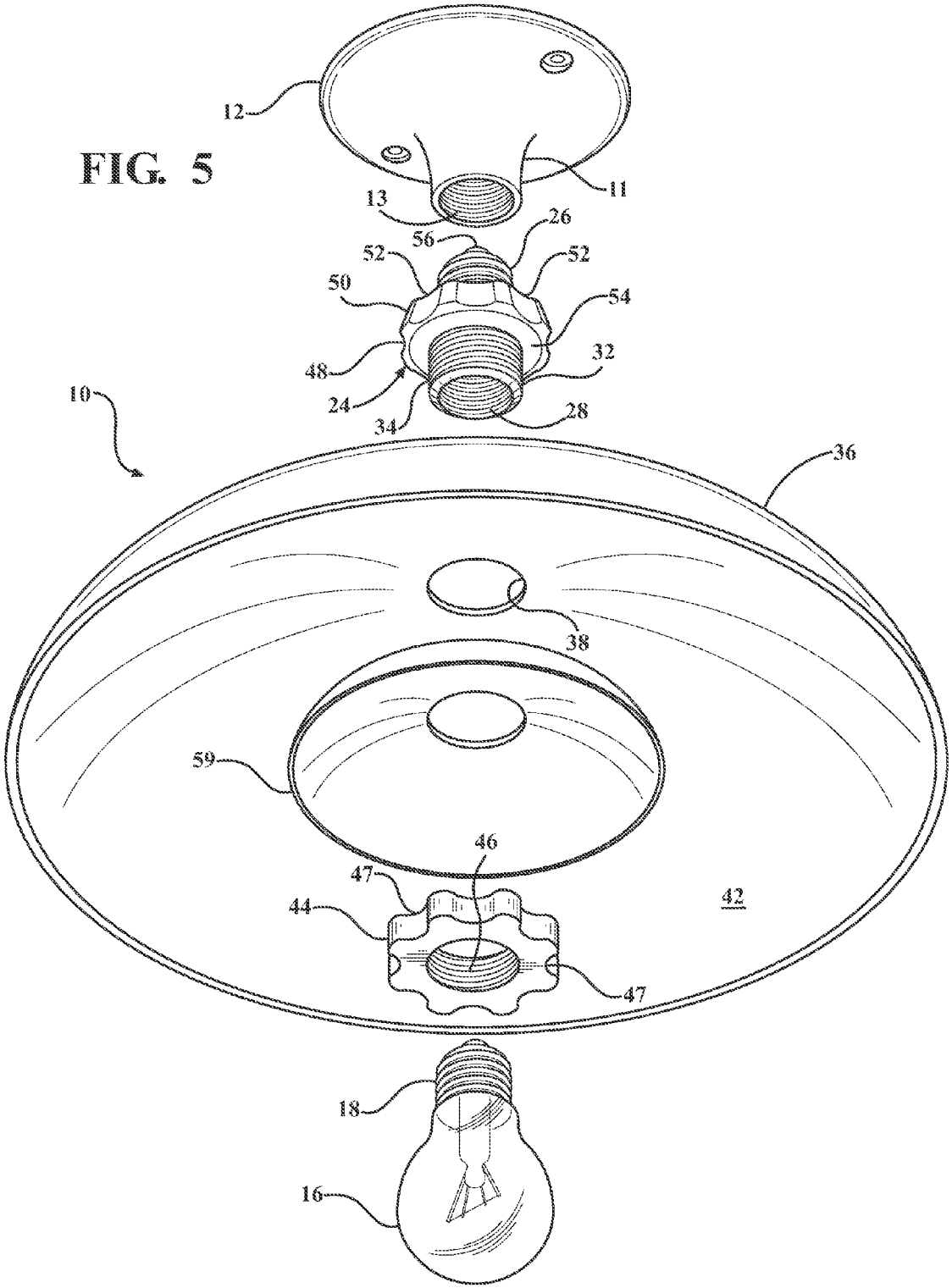
FIG. 5 is an exploded perspective view of a second embodiment of the invention secured to a ceiling lamp with a light bulb fixedly secured thereto.
Figure 6:
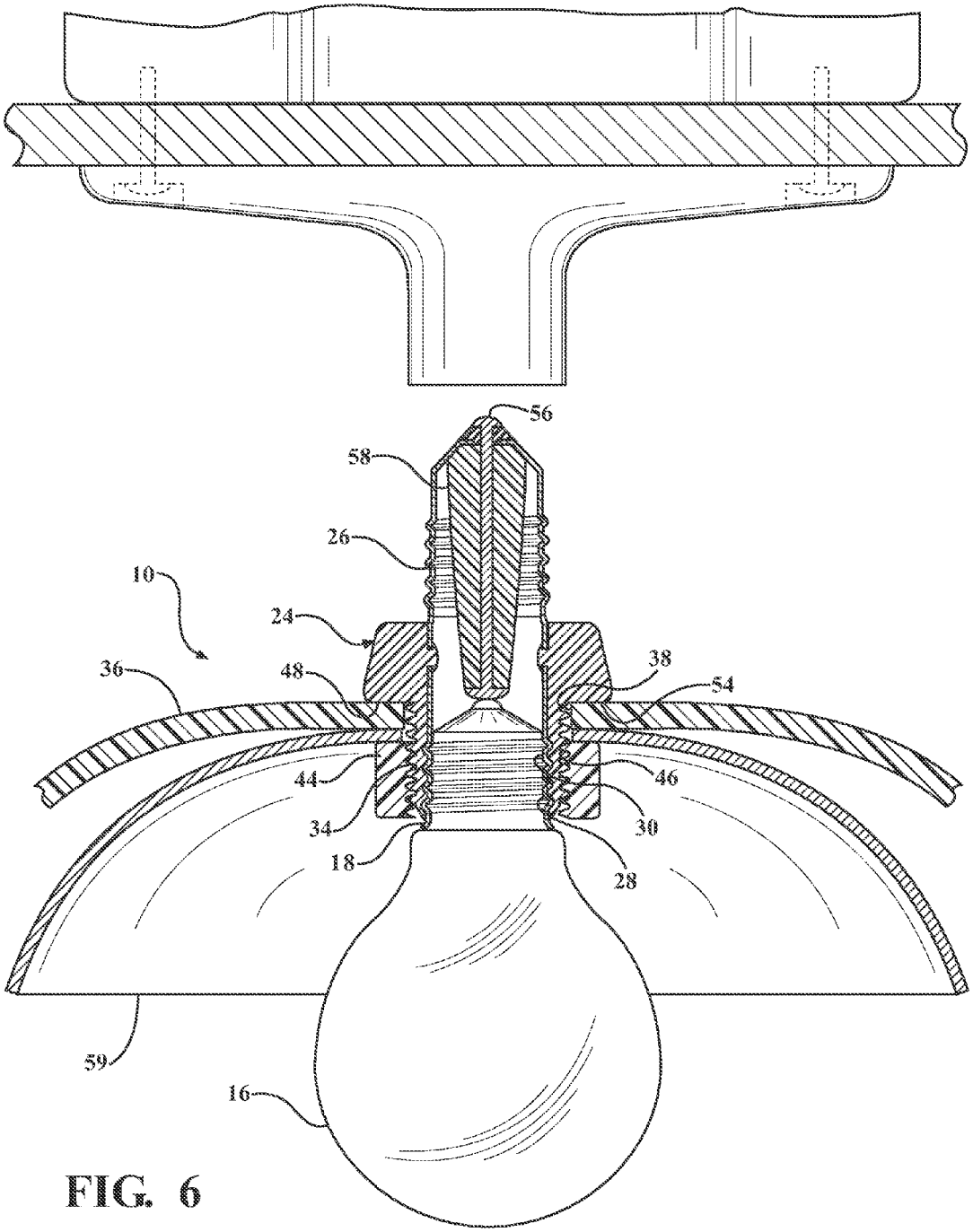
FIG. 6 is a cross-sectional side view of the embodiment shown in FIG. 5.

Referring to FIGS. 5 and 6, the embodiments shown are identical to the embodiment shown in FIGS. 1 through 4. The difference between this embodiment and the previous embodiment is the addition of a reflector 59 secured to the socket extender 24 between the lamp deflector 36 and the retainer 44. The reflector 59 reflects the light out past the lamp deflector 36 in a more direct manner. Reflector 59 also serves to reflect heat of light bulb 16 away from lamp deflector 36. The reflector 59 is shown to have a radius of curvature smaller than a radius of curvature of the lamp deflector 36. It should be appreciated by those skilled in the art that both the reflector 59 and the lamp deflector 36 may extend through arcuate planes that are not defined by a simple radius of curvature. Further still, reflector 59 and the lamp deflector 36 may not have radiuses of curvature at all and may be formed out of a set of flat surfaces.

Figure 7:
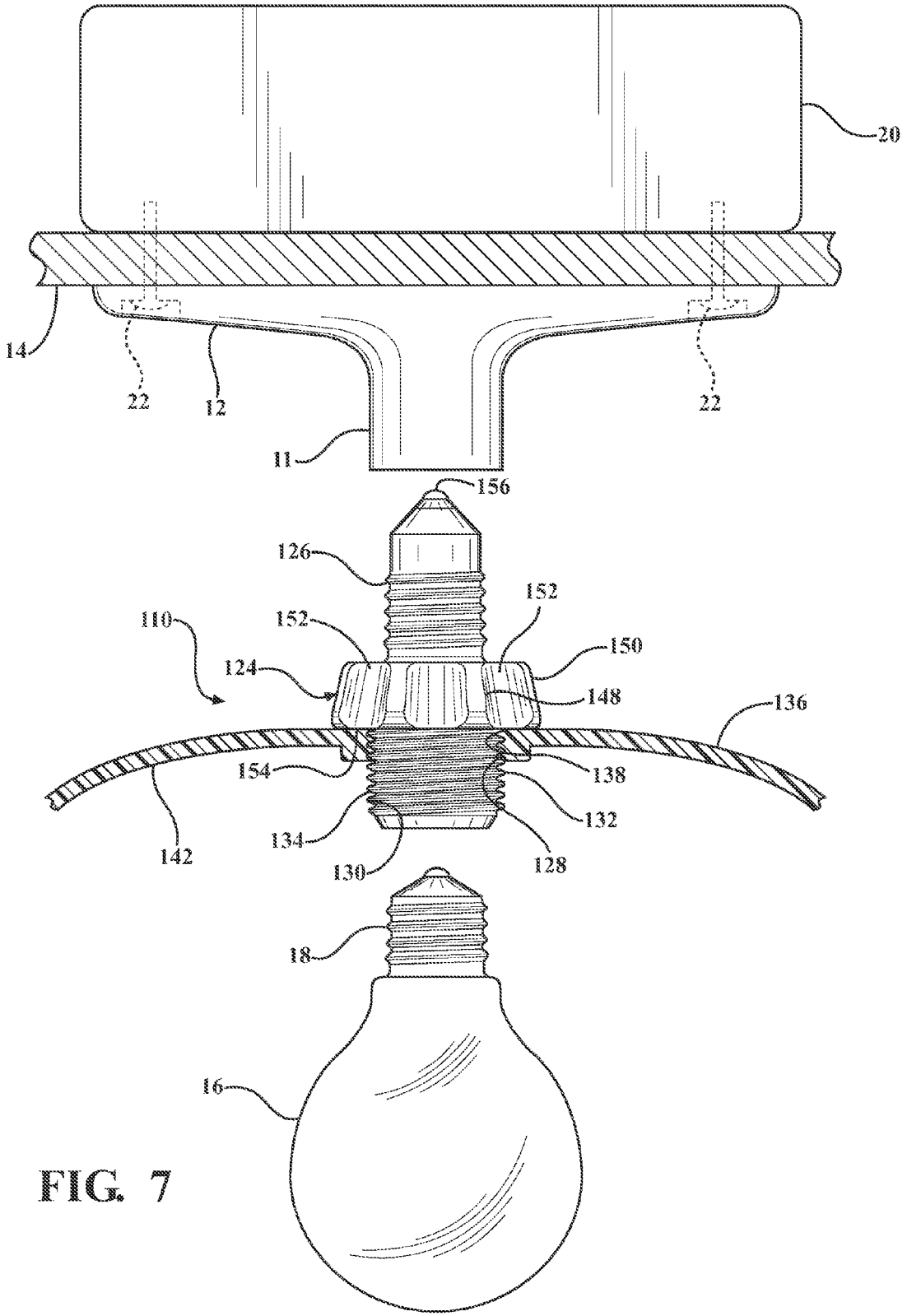
FIGS. 7 through 14 are partial cross-sectional side views of alternative embodiments of the invention.
Figure 8:
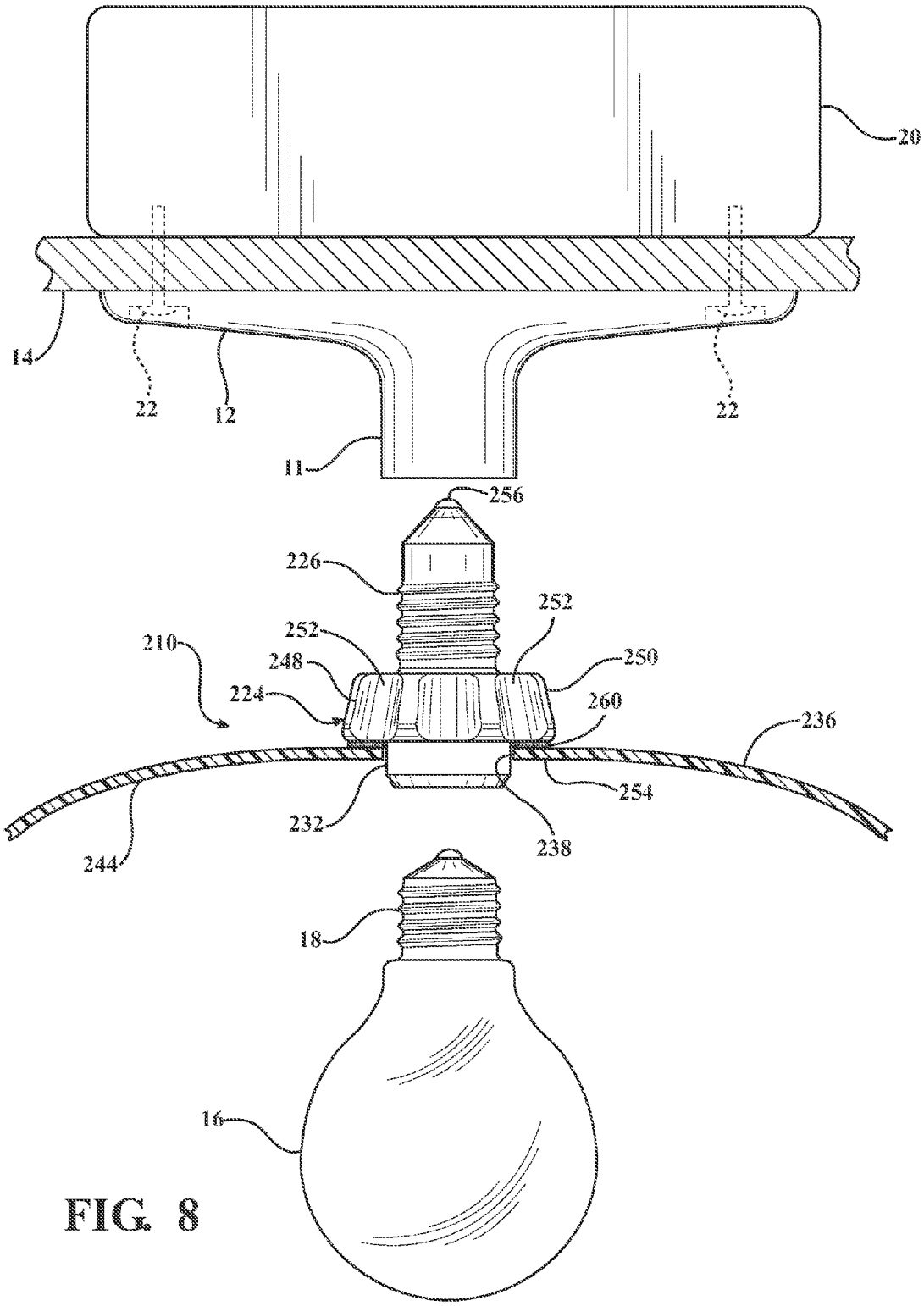

In the embodiment shown in FIG. 7, an alternative embodiment is shown wherein the retainer 44 is replaced with a lamp deflector 136 having an inner deflector circumference 138 with threads to threadingly engage the distal male threaded surface 134 of the socket extender 124. In FIG. 8, the retainer 44 of the first embodiment is replaced by having the lamp deflector 236 be secured to the deflector stop 248 with the use of an adhesive 260 applied between the lamp deflector 236 near the inner deflector circumference 238 and the relief 254 of the deflector stop 248. This adhesive 260 may be any type of adhesive or tape that would withstand the heat generated by the light bulb 16 and the weight of the lamp deflector.

Figure 9:
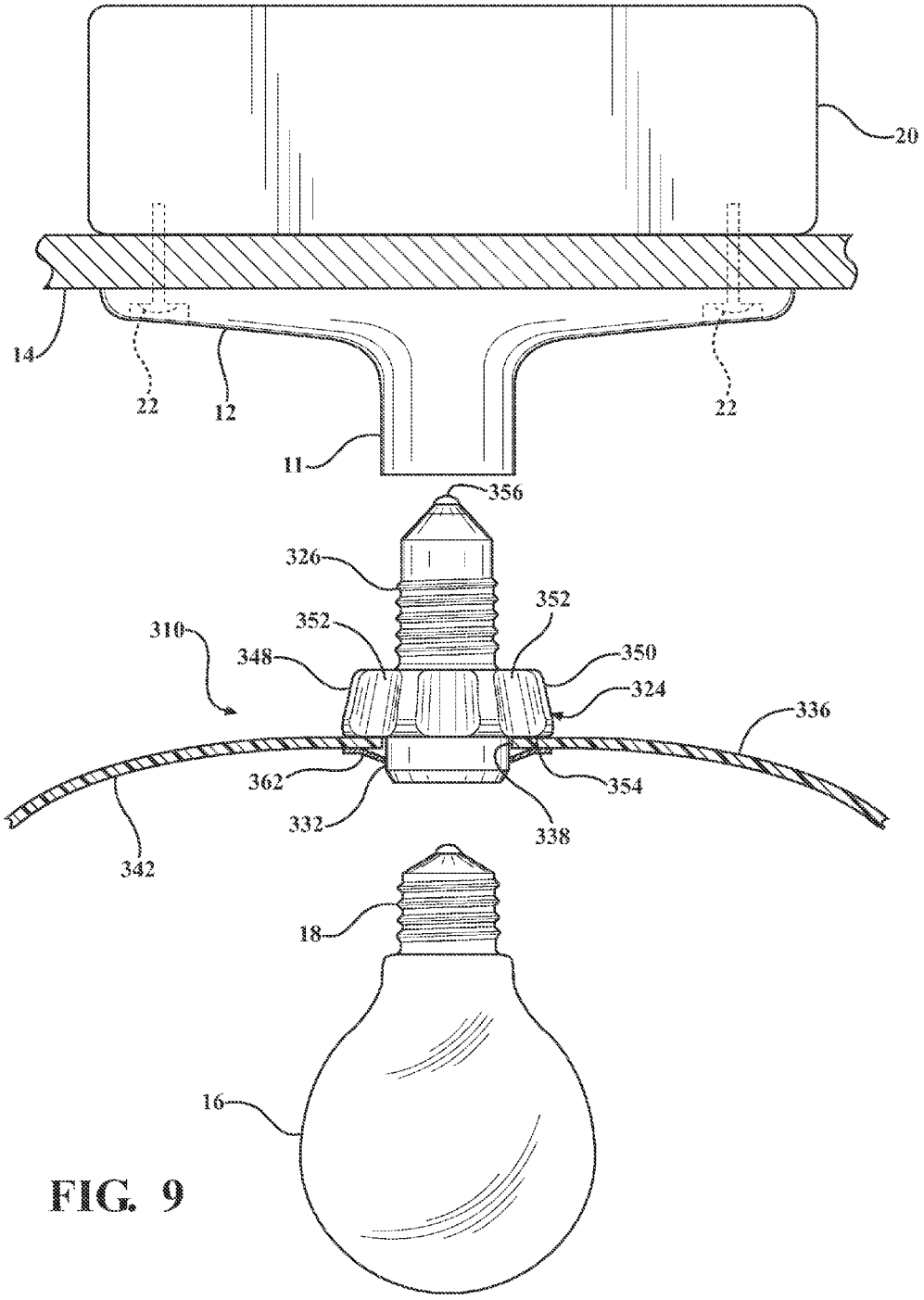
Figure 10:
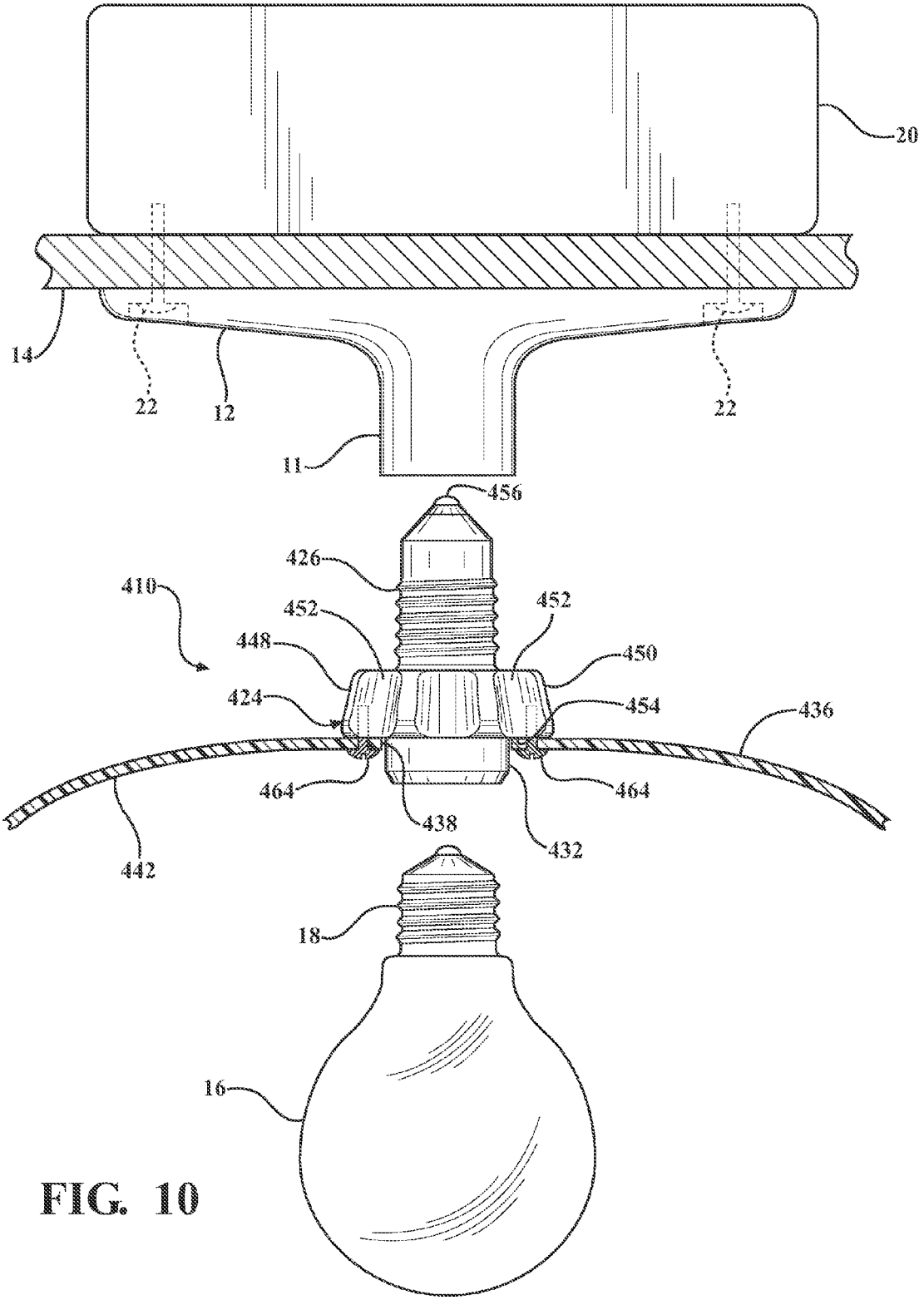

Referring to FIG. 9, a third alternative embodiment is shown wherein the retainer 44 is replaced by a push nut 362. The push nut positively engages the socket extender 324 and pushes the lamp deflector 336 against the relief 354 of the deflector stop 348. Referring to FIG. 10, the embodiment of the lamp retrofitting assembly 410 includes fasteners 464 that extend through the lamp deflector 436 and into the relief 454 of the deflector stop 448. In this embodiment 10, the deflector surface 442 is not uninterrupted; the interruptions, namely the holes through which the fasteners 464 are secured are closed when the lamp retrofitting assembly 410 is completely installed.

Figure 11:
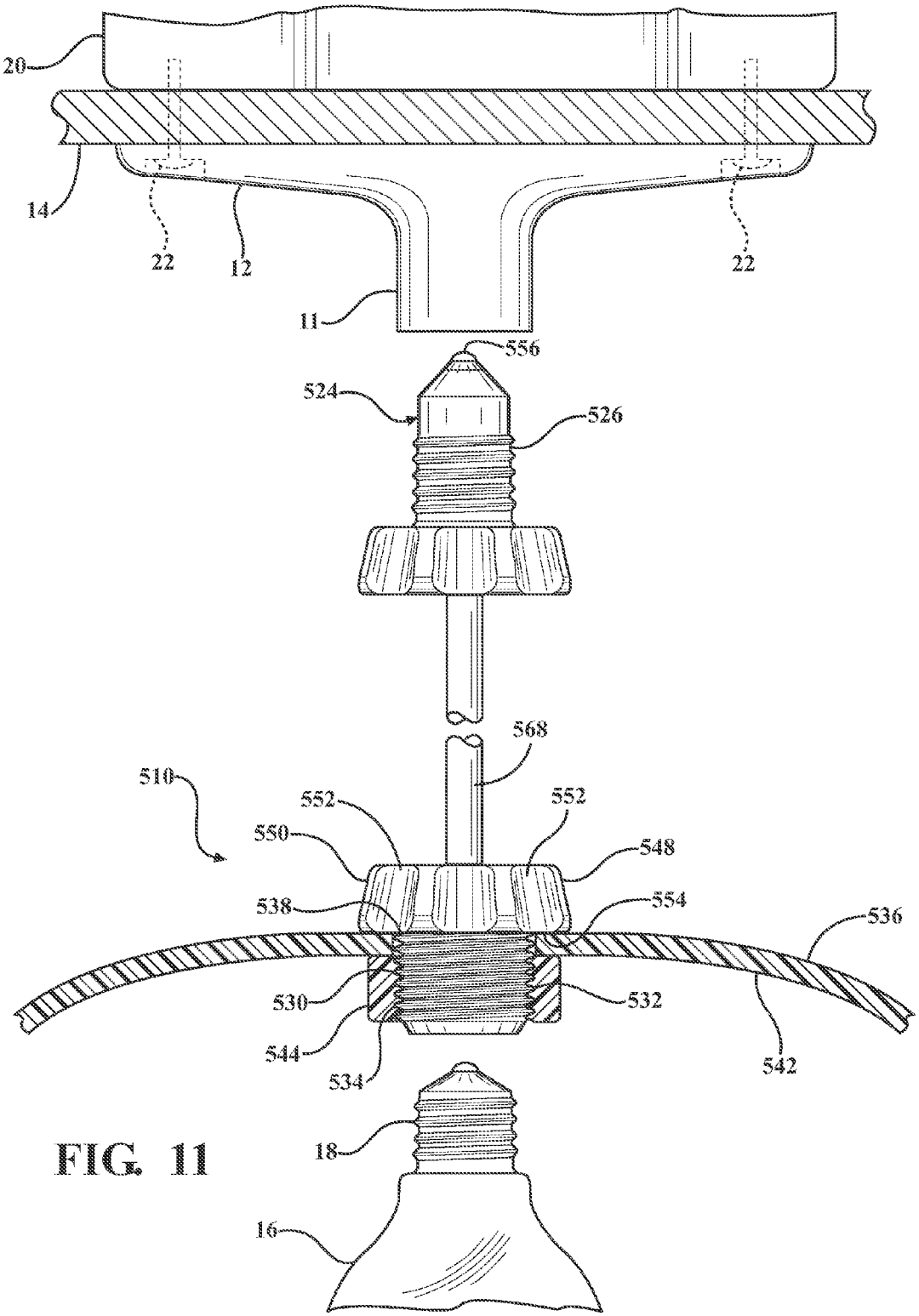

With reference to FIG. 11, the lamp retrofitting assembly 510 includes an elongated neck 568 extending between the male threaded electrical contact surface 526 and the distal male threaded surface 534 of the socket extender 524 to create a pendant style lamp retrofitting assembly 510. The neck 568 allows the light bulb 16 to be lowered with respect to the ceiling lamp 12, which remains mounted to the ceiling 14. Although not shown, the electrical circuit within the socket extender extends through the elongated neck 568 to provide current to the light bulb 16. One skilled in the art should appreciate that the options disclosed in the embodiments set forth above may be included incorporated into this embodiment.

Figure 12A:
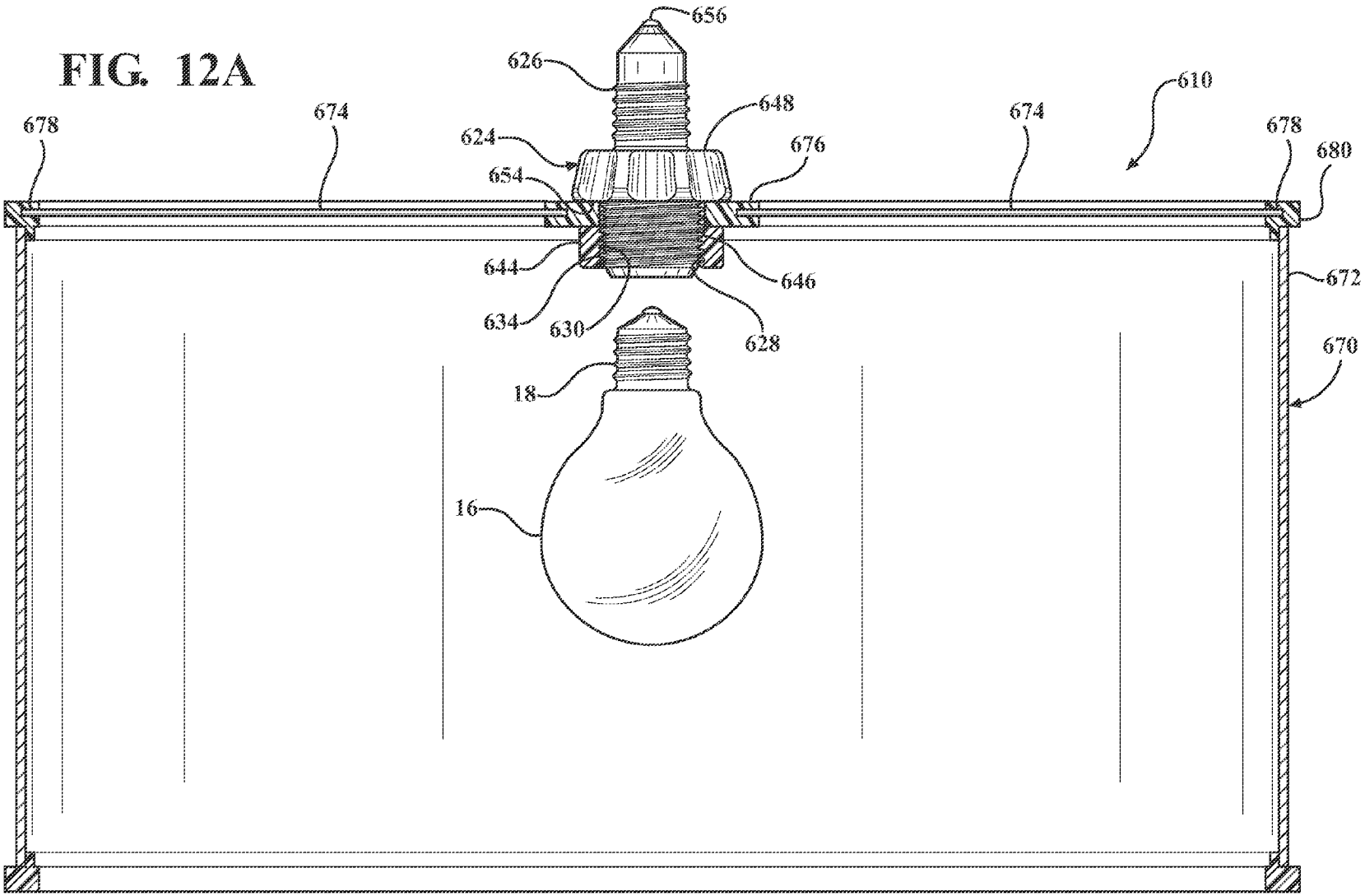
Figure 12B:
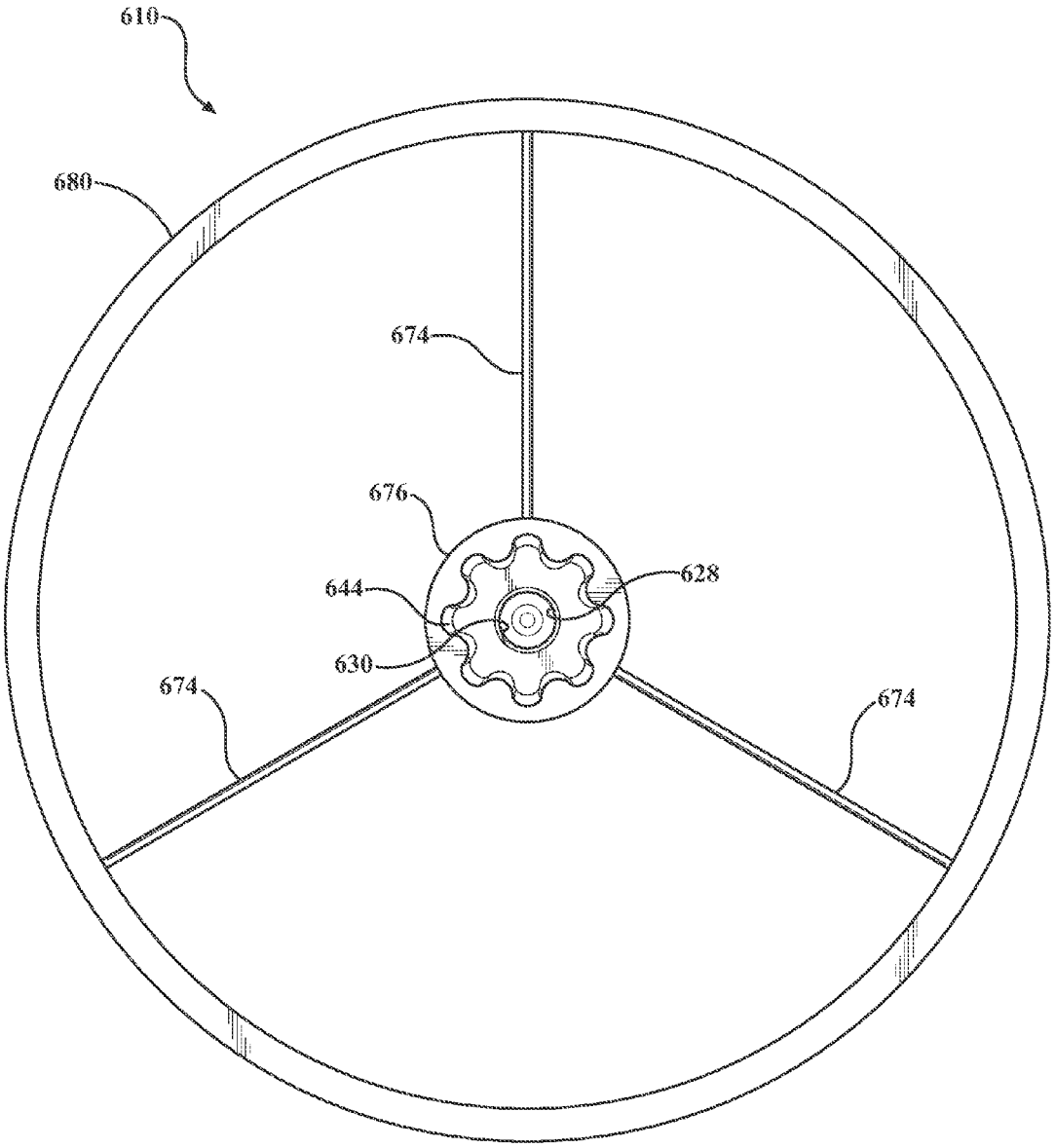

Referring now to FIGS. 12A and 12B, the lamp retrofitting assembly 610 is similarly constructed to the embodiment shown in FIGS. 1 through 4 with one distinct difference—the deflector in the first embodiment is replaced with a diffuser, generally shown at 670. The diffuser 670 is made of a translucent material that allows light to pass therethrough, but only after it has been diffused to a certain degree. In these figures, the diffuser 670 includes a sidewall diffuser 672 that is formed in the shape of a cylinder with a circular cross section. Spokes 674 extend radially out from a spoke hub 676 that is secured to the socket extender 624 between the retainer 644 and the deflector stop 648. The spokes 674 extend out to spoke distal ends 678 that are encapsulated by a diffuser frame 680. In one embodiment (not shown), the diffuser 670 may include a diffuser cover that will enclose the light bulb 16 within the diffuser 670.

Figure 13:
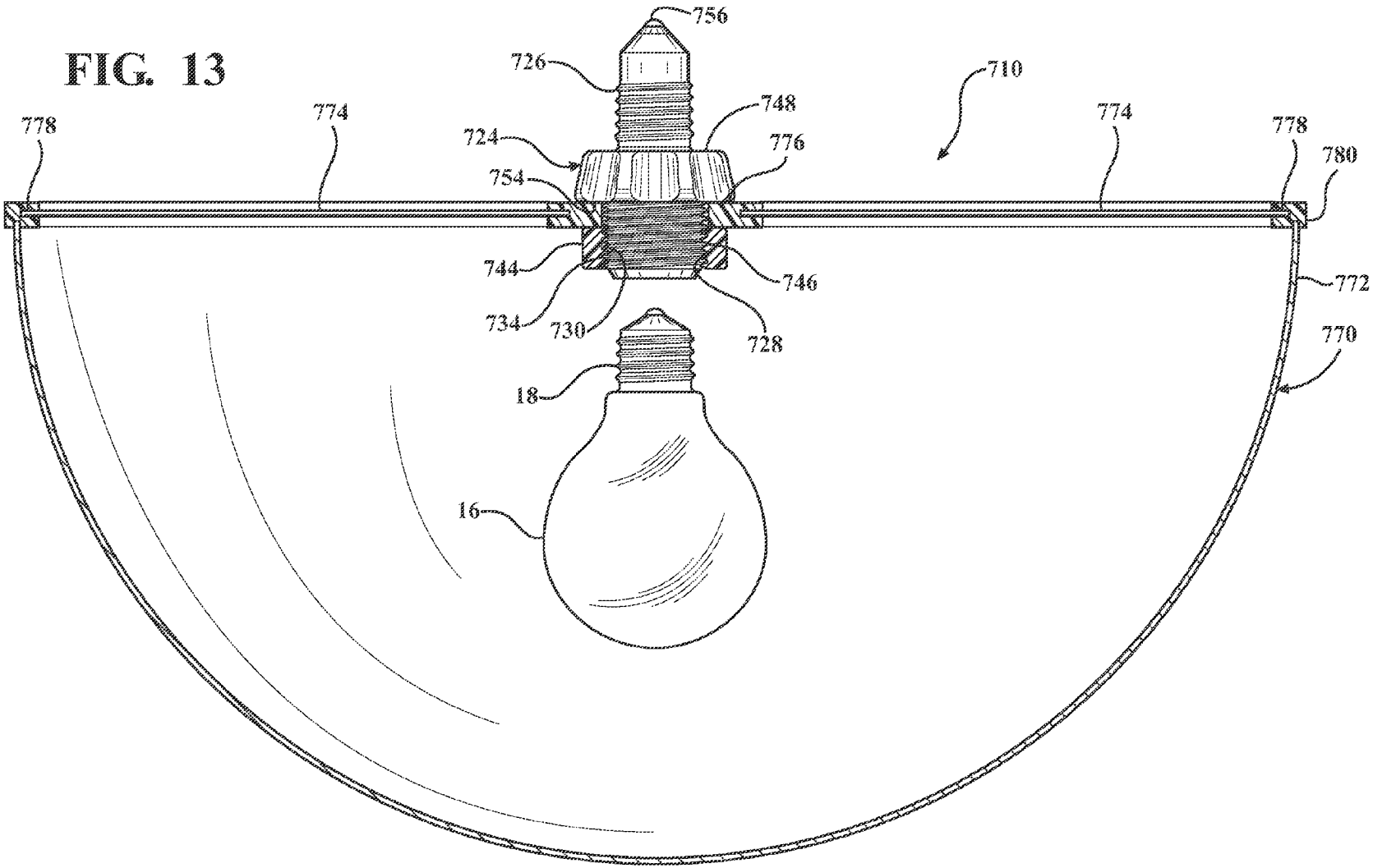

Referring to FIG. 13, the lamp retrofitting assembly 710 includes a diffuser 770 that includes a diffuser surface 772, which extends through a semi-sphere and covers the light bulb 16. The socket extender 724 is similar to that shown in FIG. 12A and FIGS. 1 through 4. In addition the diffuser 770 includes a hub and spoke construction in which hub 776 is retained by the retainer 774 or it can be made similar to FIG. 7 with a "threaded hub" to eliminate the retainer 744.

Figure 14:
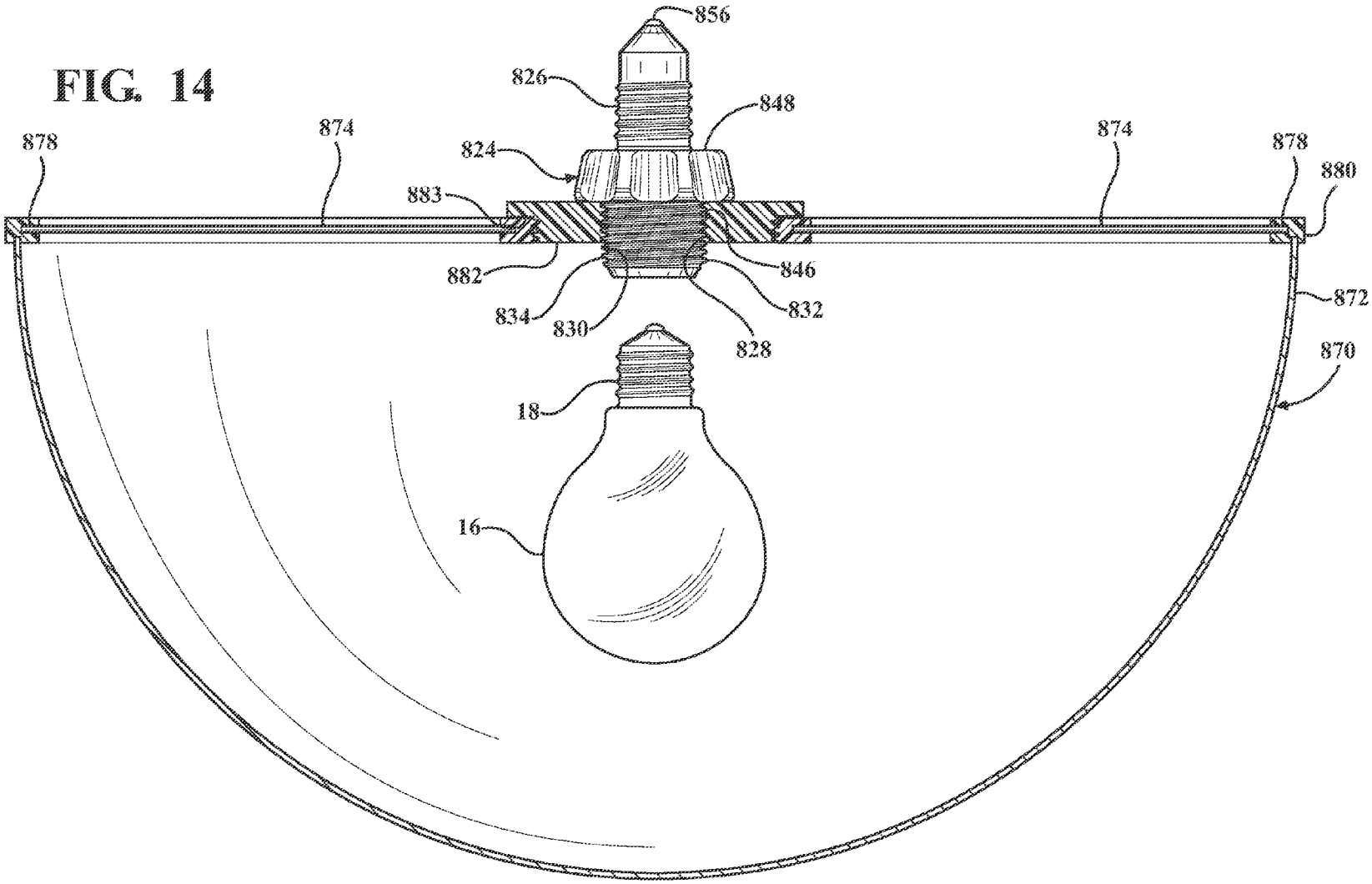

In FIG. 14, the diffuser surface 872 extends through the same arcuate surface, a semi-sphere, but the inner hub 882 threadingly engaged to socket extender 824 by engaging the distal male threaded surface 834. Alternatively, the inner hub 882 can be formed as an integral extension and part of socket extender 824. In both cases, the outer circumference of the hub 882 is a threaded surface and includes a circumferential relief extending radially acting as an upper stop surface 883 to receive and stop/tighten hub 876 and spoke 874. The sprocket 874 and its hub 876 engage threadingly onto the threaded outer diameter of hub 882. The outer diameter of inner hub 882 and threaded inner hole of hub 876 are large enough to allow passage of a hub 876 with spoke 874 around an installed light bulb. This is unlike FIG. 13 where the light bulb must be installed after securing diffuser 770 to the socket extender. Socket extender 824 is similar to that disclosed in FIG. 7 with a hub 882 threadingly engaging the distal male threaded surface 834. The difference with the embodiment of FIG. 7 is that the spokes 874 extend out of the hub 882 instead of the lamp deflector 136 of FIG. 7.

Figure 15:
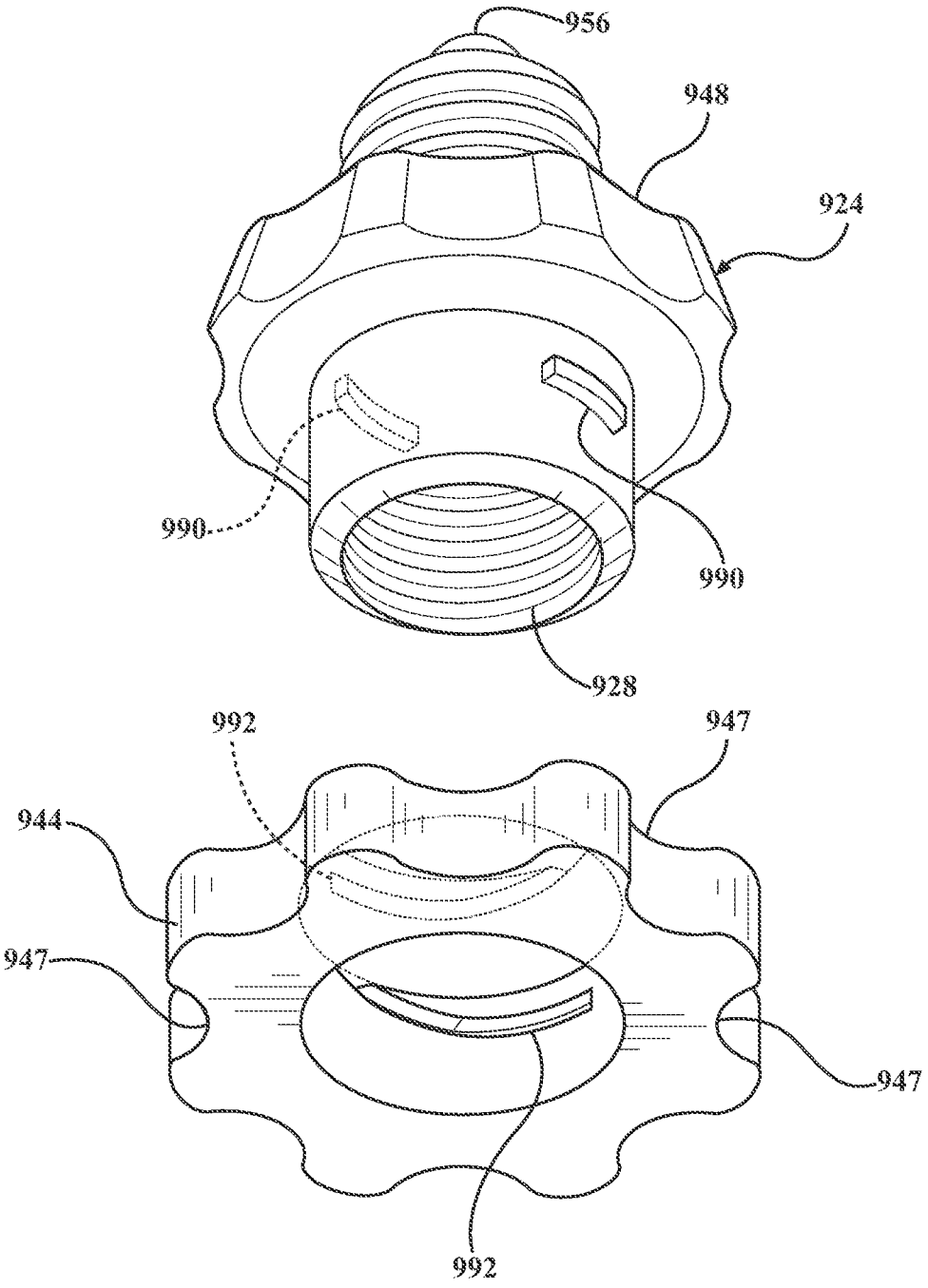
FIG. 15 is an exploded perspective view of yet another alternative embodiment of a portion of the invention.

Referring to FIG. 15, the distal male threaded surface in the prior embodiments is replaced with a plurality of protrusions or keys 990. In the embodiment shown in FIG. 15, there are two protrusions 990 that extend radially outwardly from the socket extender 924. A plurality of slots 992 are formed in the retainer 944 to receive the protrusions 990 of the socket extender 924 therein.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. A lamp retrofitting assembly for decorating a ceiling lamp including a bulb socket having a socket thread designed to receive a threaded electrical contact surface of a light bulb therein, said lamp retrofitting assembly comprising:

a socket extender having a male threaded electrical contact surface to threadingly engage the socket thread, said socket extender also including a female threaded electrical contact surface spaced apart from and in electrical contact with said male threaded electrical contact surface, wherein said female threaded electrical contact surface receives the threaded electrical contact surface of the light bulb;

a lamp deflector removably securable to said socket extender, said lamp deflector having an inner deflector circumference defining an extender hole and an outer deflector circumference and an uninterrupted deflecting surface extending therebetween, said lamp deflector receiving said socket extender within said extender hole;

a circumferential relief extending radially out from said socket extender against which said retainer secures said lamp deflector thereagainst a retainer securable to said socket extender, said retainer retaining said decorative lamp deflector to said socket extender; and a reflector secured to said socket extender between said lamp deflector and said retainer.

2. A lamp retrofitting assembly as set forth in claim 1 wherein said reflector defines an outer circumference greater than said extender hole and less than said outer deflector circumference.

3. A lamp retrofitting assembly as set forth in claim 2 wherein said deflector defines a deflector radius of curvature and said reflector defines a reflector radius of curvature such that said reflector radius of curvature is less than said deflector radius of curvature.

4. A lamp retrofitting assembly as set forth in claim 1 wherein said socket extender further includes a distal male threaded surface to threadingly secure said retainer to said socket extender.

5. A lamp retrofitting assembly as set forth in claim 4 wherein said retainer includes a retainer female thread to threadingly engage said distal male threaded surface.

6. A lamp retrofitting assembly as set forth in claim 1 wherein said retainer is a push nut that is fixedly secured over said socket extender.

7. A lamp retrofitting assembly as set forth in claim 4 wherein said retainer is formed in said lamp deflector.

8. A lamp retrofitting assembly as set forth in claim 7 wherein said retainer includes a retainer female thread to threadingly engage said distal male threaded surface.

9. A lamp retrofitting assembly as set forth in claim 1 including an adhesive disposed between said circumference relief and said lamp deflector to secure said lamp deflector to said circumferential relief.

10. A lamp retrofitting assembly as set forth in claim 1 including a plurality of fasteners to fixedly secure said lamp deflector to said circumferential relief.

* * * * *